US007821240B2

(12) United States Patent
Oddoart et al.

(10) Patent No.: US 7,821,240 B2
(45) Date of Patent: Oct. 26, 2010

(54) VOLTAGE REGULATOR WITH PASS TRANSISTORS CARRYING DIFFERENT RATIOS OF THE TOTAL LOAD CURRENT AND METHOD OF OPERATION THEREFOR

(75) Inventors: Ludovic Oddoart, Frouzins (FR); Gerhard Trauth, Muret (FR)

(73) Assignee: Freescale Semiconductor, Inc., Austin, TX (US)

( * ) Notice: Subject to any disclaimer, the term of this patent is extended or adjusted under 35 U.S.C. 154(b) by 375 days.

(21) Appl. No.: 11/996,239

(22) PCT Filed: Jul. 21, 2005

(86) PCT No.: PCT/EP2005/009178

§ 371 (c)(1),
(2), (4) Date: Jan. 18, 2008

(87) PCT Pub. No.: WO2007/009484

PCT Pub. Date: Jan. 25, 2007

(65) Prior Publication Data

US 2008/0191670 A1 Aug. 14, 2008

(51) Int. Cl.
*G05F 1/40* (2006.01)

(52) U.S. Cl. ..... 323/269; 323/280; 323/274

(58) Field of Classification Search ..... 323/269, 323/271–274, 280, 282, 284, 351
See application file for complete search history.

(56) References Cited

U.S. PATENT DOCUMENTS

| | | | | |
|---|---|---|---|---|
| 5,528,127 | A | 6/1996 | Streit | |
| 6,677,737 | B2 * | 1/2004 | Hamon et al. | 323/280 |
| 6,897,715 | B2 | 5/2005 | Barber, Jr. et al. | |
| 7,106,032 | B2 * | 9/2006 | Chen et al. | 323/269 |
| 7,148,670 | B2 * | 12/2006 | Inn et al. | 323/283 |

* cited by examiner

*Primary Examiner*—Jessica Han

(57) ABSTRACT

A voltage regulator for providing a voltage regulated output to a load comprises a first loop and a second loop. The first loop comprises a first active device coupled to a first pass device and configured to provide a first, relatively high current output to the load. The second loop comprises a second active device coupled to a second pass device and configured to provide a second, relatively low current output to the load. This provision of two independent loops reduces the quiescent current provided by the voltage regulator under low load conditions.

20 Claims, 3 Drawing Sheets

VOLTAGE REGULATOR WITH PASS TRANSISTORS CARRYING DIFFERENT RATIOS OF THE TOTAL LOAD CURRENT AND METHOD OF OPERATION THEREFOR

FIELD OF THE INVENTION

This invention relates to voltage regulators. The invention is applicable to, but not limited to, improving the performance of a voltage regulator over the range of possible loads supported by the voltage regulator.

BACKGROUND OF THE INVENTION

A low drop-out (LDO) voltage regulator is a regulator circuit that provides a well-specified and stable DC voltage (whose input-to-output voltage difference is typically low). The operation of the circuit is based on feeding back an amplified error signal, which is used to control output current flow of a 'pass' device (such as a power transistor) driving a load. The drop-out voltage is the value of the input/output differential voltage where regulation is lost.

The low drop-out nature of the regulator makes it more appropriate, in contrast to other types of regulators such as dc-dc converters and switching regulators, for use in many applications, such as automotive, portable, and industrial applications. In the automotive industry, a low drop-out voltage is necessary during cold-crank conditions, where an automobile's battery voltage can fall below 6V. Increasing demand for LDO voltage regulators is also apparent in mobile battery operated products (such as cellular phones, pagers, camera recorders and laptop computers), where the LDO voltage regulator typically needs to regulate under low voltage conditions with a reduced voltage drop.

A known LDO voltage regulator uses a differential transistor pair, an intermediate stage transistor, and a pass device coupled to a large (external) bypass capacitor. These elements constitute a DC regulation loop that provides voltage regulation.

In the field of voltage regulators, there is no voltage regulator currently available on the market that provides an efficient, high-performance voltage regulation over a wide range of possible loads, whilst maintaining an ultra-low bias current that ensures minimum current consumption in standby mode (i.e. when there is no load).

In this regard, the strategy adopted by all manufacturers, consists of making a performance versus consumption tradeoff. Thus, the regulator performance suffers from either:

(i) The transient performance of the voltage regulator is poor, if it is operating at a relatively low current (Icc) for all loads; or (ii) The regulator is likely operating inefficiently, if the voltage regulator is operating with a relatively high current (Icc) for all possible loads.

Referring now to FIG. 1, a classic voltage regulator topology 100 is illustrated. The classic topology 100 comprises a 3-stage Amplifier, where:

(i) A first stage 110 of the voltage regulator operates as a differential pair of transistors with an active load;

(ii) A second stage 120 is a buffer stage with pole tracking; and (iii) A third stage 130 is a 'pass' device 135 driving the load current.

An external capacitance 140 is provided to provide fast buffering to accommodate load changes. In addition, a pair of resistors 150 is provided in parallel to the external capacitance 140, where the resistor ratio defines the output voltage ($V_{out}$); in this case $2\times V_{REF}$. A minimum current is fixed through these feedback resistors and the output 'pass' device 135 to ensure the loop is stable (i.e. the open loop gain is limited).

Of note is the typical current drawn (Icc) per stage:

| | | |
|---|---|---|
| (i) | first stage of approximately | ~15 uA; |
| (ii) | second stage of approximately | ~2 uA; and |
| (iii) | third stage of approximately | ~2-4 uA |

This results in a total quiescent current drawn of approximately ~20 uA, notably without a load. Thus, the inventors of the present invention have recognized and appreciated that an improved voltage regulator arrangement is needed to reduce this high current consumption value, particularly when such a current level is not required by the load.

To appreciate the problems associated with the classic topology of FIG. 1, it is worth considering the corresponding pole tracking plot 200 of the classic voltage regulator circuit, as illustrated in FIG. 2. Here, the voltage regulator is shown with 3-poles and 1-zero to ensure stability.

The pole tracking 200 is illustrated for both low loads 210 and high loads 220 of the voltage regulator. A first pole 230 for both loads is shown due to the output stage, where:

$$f_{OUT} = g_{m7} \cdot (r_{DS7} \,//\, R_L) \frac{1}{1 + j\omega C(r_{DS7} \,//\, R_L)} \quad [1]$$

Here, the gain of output stage changes with Load current $$g_{m7} \cdot (r_{DS7} \,//\, R_L) \propto \frac{1}{\sqrt{I}} \quad [2]$$

Furthermore, the first pole 230 of the output stage is shown as changing with load current:

$$r_{DS7} \,//\, R_L \propto \frac{1}{I_L} \quad [3]$$

A zero 240 results from the equivalent series resistance (ESR). A second pole 250 is illustrated, which is due to the differential pair of transistor arrangement. A third pole 260 is illustrated as a result of the buffering circuit.

Thus, as can be readily appreciated, increasing the load results in the following circuit changes:

(i) The Pole increases faster;

(ii) The Gain decreases 270; and (iii) There is more remaining gain at higher frequencies, which is highly undesirable.

Thus, there exists a need in the field of voltage regulators to optimise current efficiency, thereby improving battery life when the voltage regulator is used in a portable product, such as a mobile phone. In particular, the improvement in efficiency needs to be provided without any loss in performance or significant additional die size.

STATEMENT OF INVENTION

In accordance with the preferred embodiment of the present invention, there is provided a voltage regulator circuit, an integrated circuit and a method of providing a regulated voltage therefor, as claimed in the accompanying Claims.

Figure 1:
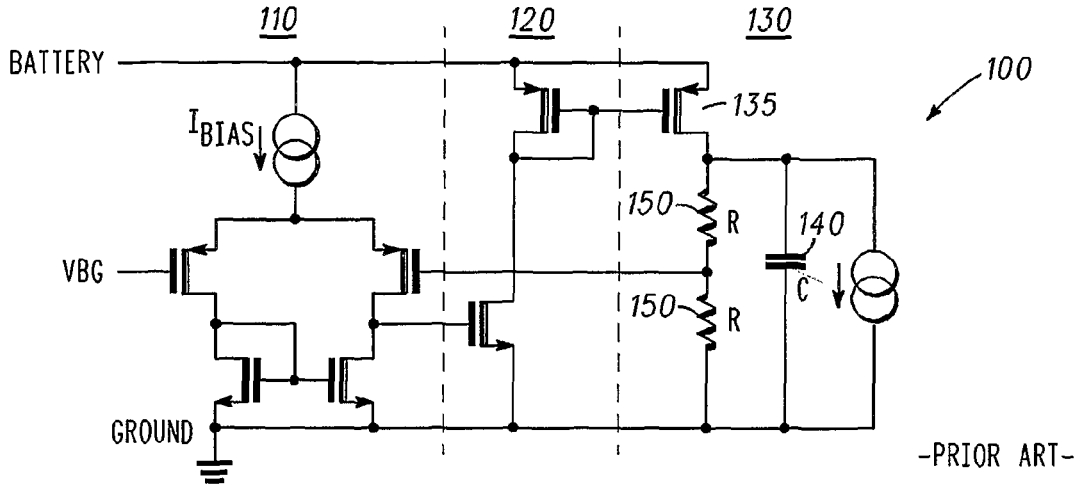
FIG. 1 illustrates a classic voltage regulator topology.
Figure 2:
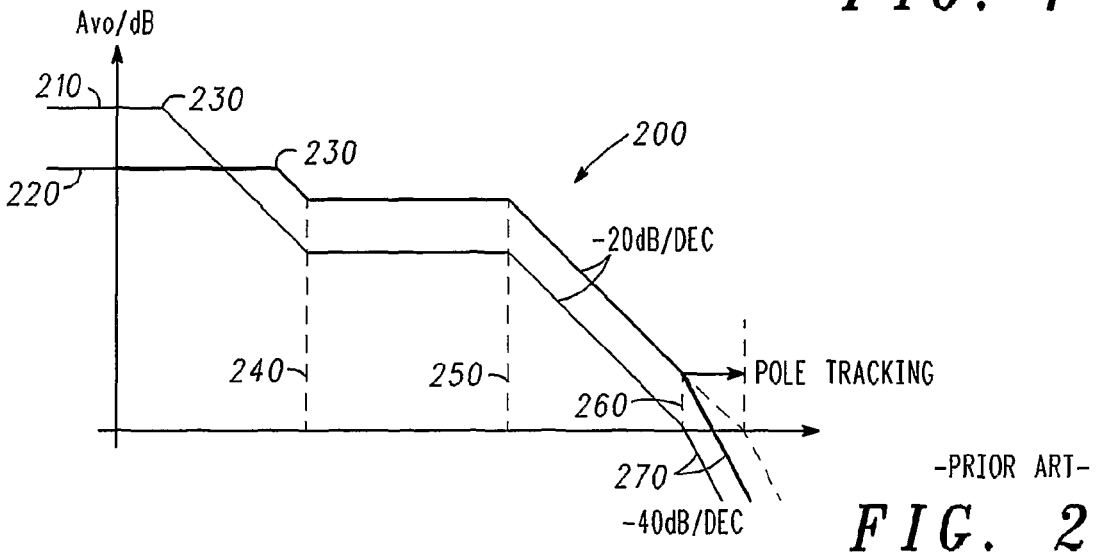
FIG. 2 illustrates a pole tracking plot of the classic voltage regulator topology.
Figure 3:
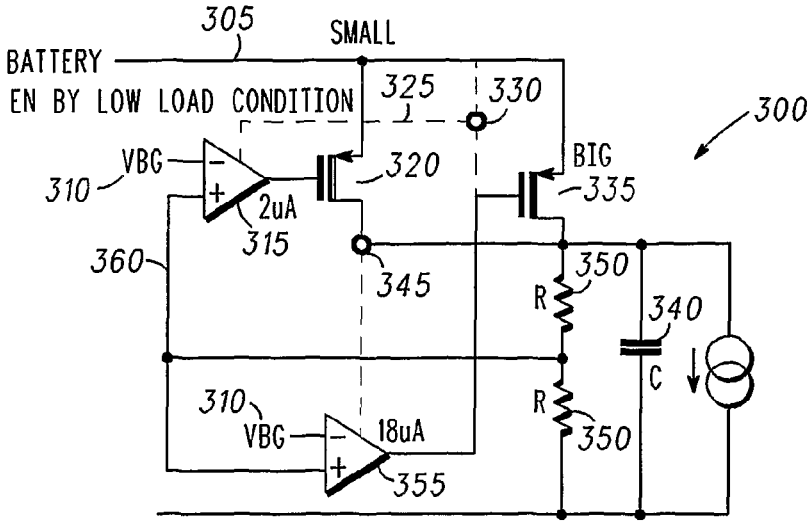
Figure 4:
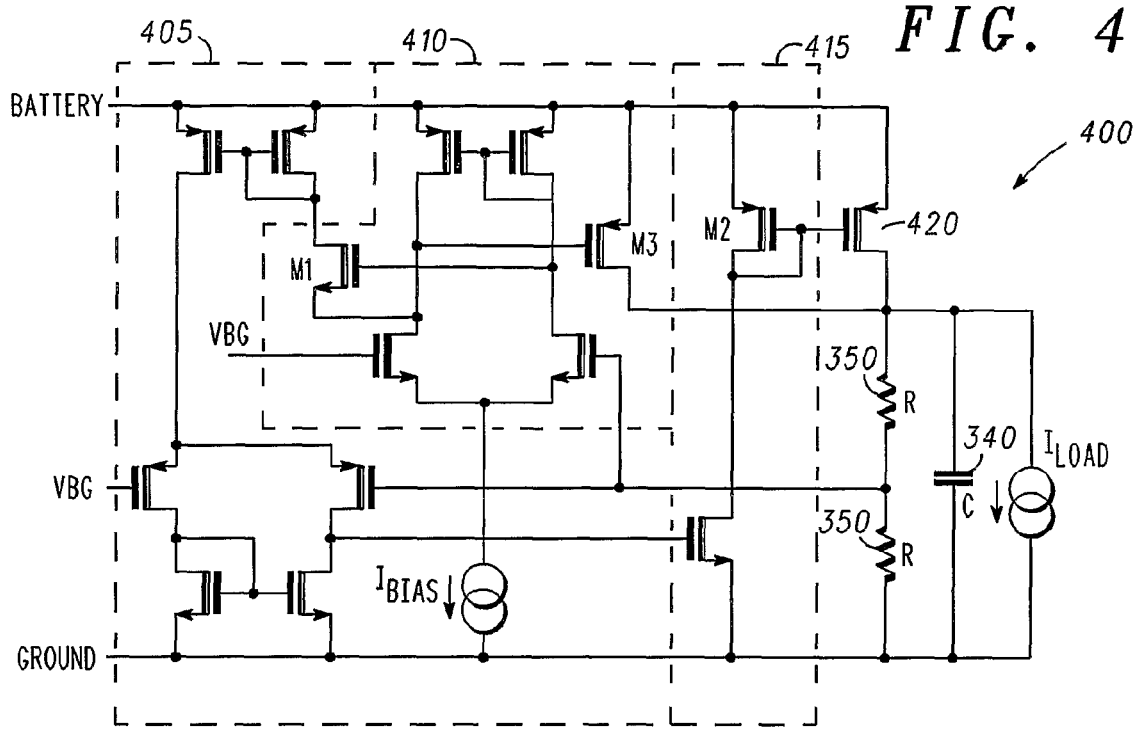
Figure 5:
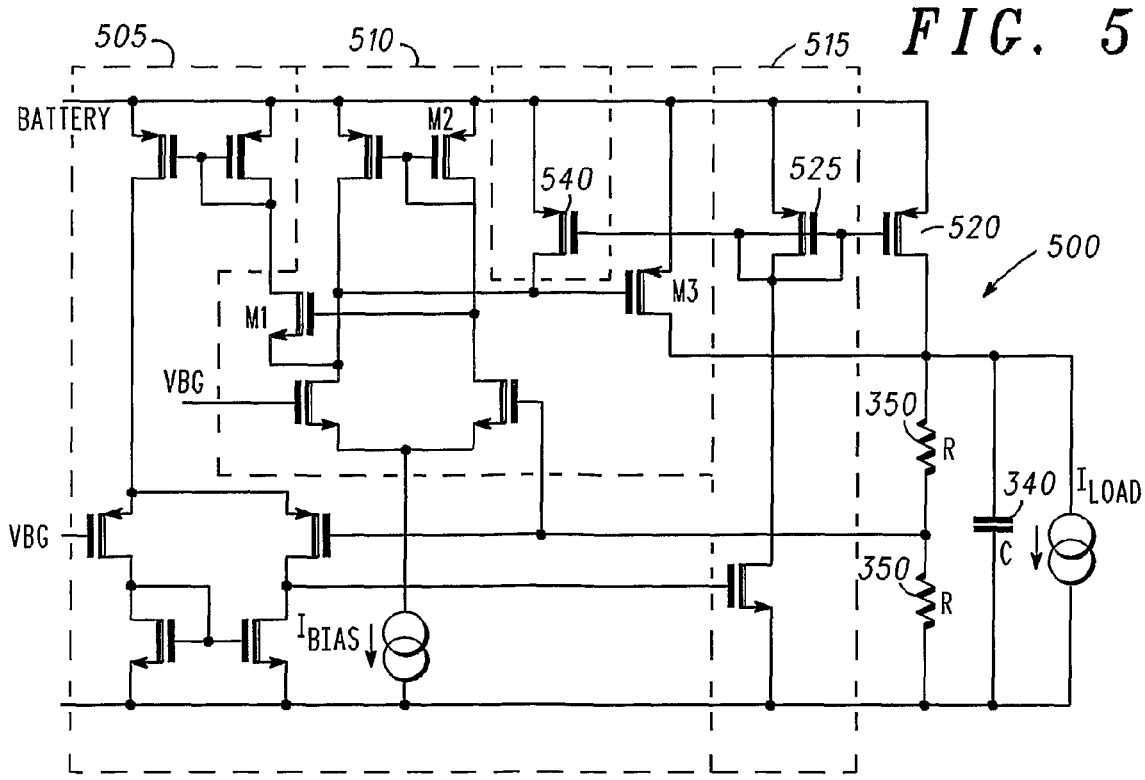
Figure 6:
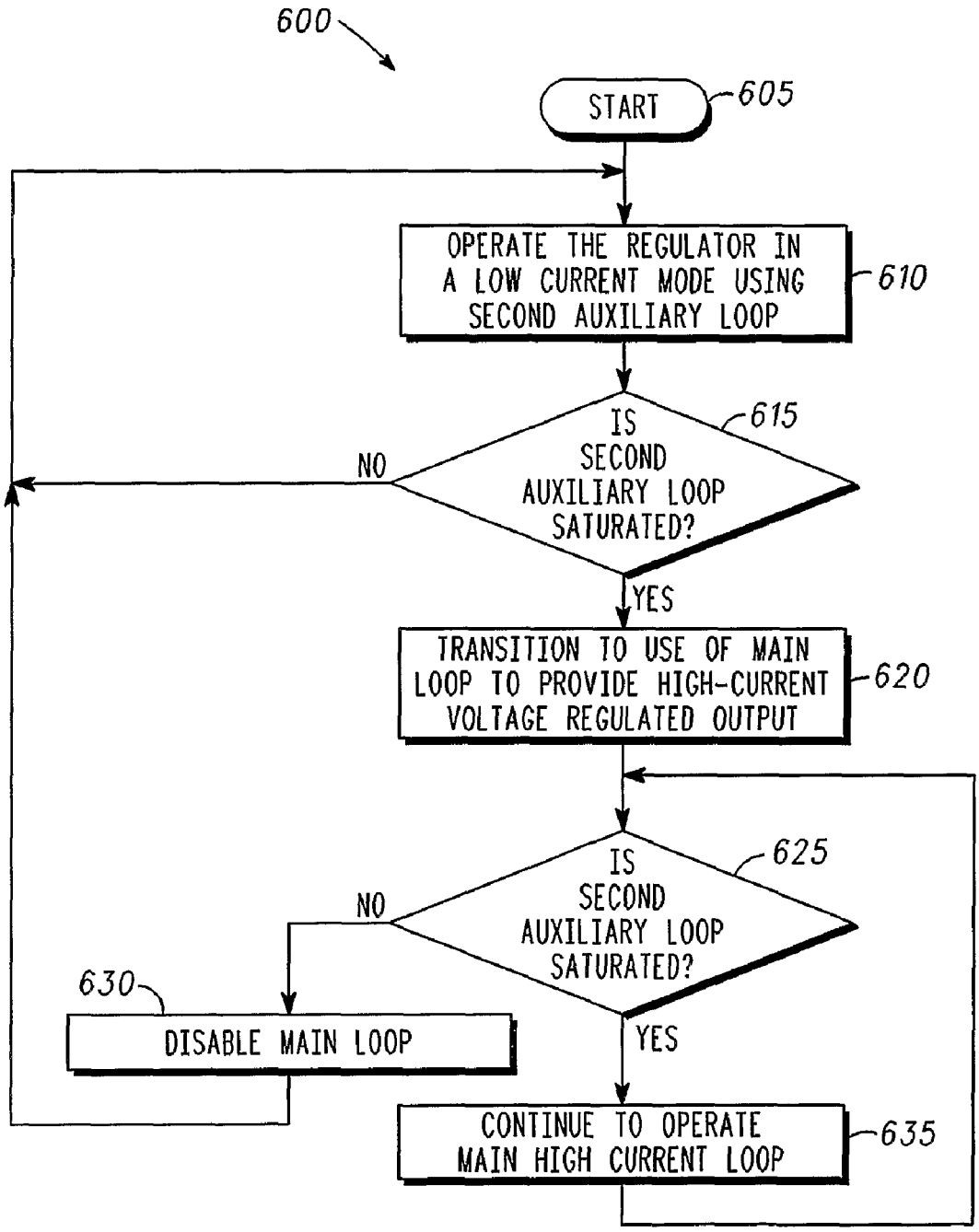

Embodiments of the present invention will now be described, by way of example only, with reference to the accompanying drawings, in which:

FIG. 3 illustrates a voltage regulator using a double loop architecture in accordance with a preferred embodiment of the present invention;

FIG. 4 illustrates a voltage regulator topology in accordance with the preferred embodiment of the present invention;

FIG. 5 illustrates the voltage regulator topology with positive feedback to the low-current loop, in accordance with the preferred embodiment of the present invention; and FIG. 6 illustrates a flowchart of the preferred mechanism to transition between a plurality of loops, such as two loops—one supporting high current and one supporting low current—dependent upon the load conditions, in accordance with the preferred embodiment of the present invention.

DESCRIPTION OF PREFERRED EMBODIMENTS

In summary, the preferred embodiment of the present invention provides a voltage regulator that is divided into two distinct sub-regulators, effectively operating in parallel. In this manner, a first sub-regulator of the preferred embodiment is capable of providing a low quiescent current (Icc) regulator for low loads, with the second sub-regulator effectively supporting other load currents.

Advantageously, an architecture is provided that facilitate an automatic optimization of the regulation loop in response to the load. The architecture is based on the same fundamental principle of operation, as illustrated in the voltage regulator architecture 300 of FIG. 3.

The voltage regulator architecture 300 of the preferred embodiment of the present invention, as illustrated in FIG. 3, uses a double loop architecture. A first loop is configured to perform the main voltage regulator operation, which is the high current mode of operation and referred to as the 'main loop'. For example, it is proposed that the main loop handles, say, from 90% to 99.9% of the maximum specified load current of the voltage regulator.

Hence, the main loop comprises a known three stage loop to maintain a high regulation performance having a reference voltage (e.g. the voltage band gap (VBG)) 310 applied to the negative port of the high current source amplifier 355. The output of the high current source amplifier 355 is applied to the base port of a first voltage regulator NMOS transistor 335, which is supplied by a reference voltage, such as a battery voltage 305.

A second loop is configured to perform a low-current auxiliary loop voltage regulator operation. For example, it is proposed that the second auxiliary loop handles, up to 10% of the total current requirements of the voltage regulator, that is from 0.1% to 10% of the maximum load current specified. Advantageously, as this second auxiliary loop does not have to ensure regulation with a high load current, the associated power pass device may be small in size. Consequently, the second loop can be designed with only two stages, such that the bias current can be provided at a minimum value.

Although the preferred embodiment of the present invention has proposed a ratio of, say, 10% of the maximum load current specified being handled by the second auxiliary loop with the main loop handling 90% of the maximum specified load current, it is envisaged that alternative ratios can be utilized. For example, in some situations, it may be more appropriate to organize a 40%-60% ratio between the relatively low current value provided by the second auxiliary loop and the relatively high current value provided by the main loop.

The auxiliary loop also comprises a reference voltage (e.g. from voltage band gap) VBG 310 applied to the negative port of a low current source operational amplifier 315. The output of the low current source operational amplifier 315 is applied to the base port of a second voltage regulator NMOS transistor 320, which is also supplied by a reference voltage, such as a battery voltage 305. Notably, the operation of the second auxiliary loop is enabled upon determination of a low load condition.

In order to obtain a behaviour where the main loop and the auxiliary second loop are optimized for regulation and bias current, an automatic switching from the main loop to the auxiliary loop is preferably implemented.

Advantageously, the two-stage auxiliary second loop is activated for light loads. In response to an increasing output current, up to a level where the loop is unable to sustain the value of the output current, its saturation is sensed (e.g. saturation of the low current source operational amplifier 315 is detected). When the saturation is detected, the low current loop is disabled, i.e. there is a high load; the high current (main) loop is then activated to ensure high load current regulation. Similarly, if no saturation in the low current source operational amplifier 315 is detected, the high current loop is disabled and operation switches solely to the low-current (low-load) auxiliary second loop.

In the context of the present invention, the term 'loop' encompasses the circuit elements used in the respective modes of operation, either a low-current mode or a high-current mode. In the preferred embodiment of the present invention, the two loops are operated independently, with the auxiliary second loop dedicated for use with light loads and the main loop dedicated to, and activated for use with, heavy loads. However, it is within the contemplation of the present invention that an alternative topology could be designed whereby the auxiliary second loop(s) is/are configured to support a light load and an extension of this to incorporate the main loop is used to support high loads.

Referring now to FIG. 4, a first embodiment of the present invention proposes an architecture that comprises the classical 3-stage design main regulator. In addition, a low quiescent (low consumption) current regulator 415 is also provided. The low quiescent current regulator 415 is advantageously and dynamically introduced when active light loads are used, in the following manner.

Transistor M1, located within circuit 410, is arranged to perform the selection of the adequate loop for the current load. Under low-load conditions this transistor M1 is turned 'off' and no current is conducted. Thus, the high current loop 405 is inactive. Increasing the output load leads to a higher Vgs of transistor M3. As soon as Vgs_M3 increases sufficiently, for example becomes larger than Vgs_M2+Vt_M1, (where Vt is a threshold voltage), transistor M1 starts to conduct current. This is the condition whereby transistor M3 is detected as no longer being able to conduct the required output current. Thus, the second (main) high-current loop must be enabled to drive the load current.

As soon as Vgs_M3 decreases to less than Vgs_M2+Vt_M1, transistor M1 turns 'on' and current is conducted into the current mirror 405, providing a high current regulator loop. As this (main) loop is now polarized with a bias current, it starts to regulate the output voltage to ensure sufficient current to the required higher loads. As soon as Vgs_M3 decreases to less than Vgs_M2+Vt_M1, transistor M1 turns 'off' and no more current is conducted into the current mirror 405. As the high current loop does not have any more bias current it stops regulating the output, as there is no more current in the positive feedback that turns off M3 (i.e. the pass device of the low quiescent current loop). The low load regulation loop becomes actice to drive the low load output current.

In addition, a series of NMOS transistors are introduced between the main regulator and the low current regulator to act as a low quiescent loop saturation detection mechanism 410.

Finally, a known common resistor feedback ladder 350 is provided, where the resistor ratio defines the output voltage ($V_{out}$). An associated external capacitor 340 is incorporated to provide fast buffering to accommodate load changes, as in the known classical topology.

Thus, depending on the current load, the operation of the proposed architecture advantageously shifts from the low quiescent loop 415 to the main regulator loop 405.

Of course, it is envisaged that the various components within the voltage regulator circuit 400 can be arranged in any suitable functional topology able to utilise the inventive concepts of the present invention. Furthermore, it is envisaged that the various components within the voltage regulator topology can be realised in discrete or integrated component form, with an ultimate structure therefore being merely an application-specific selection.

Referring now to FIG. 5, the circuit 500 illustrates the arrangement once the high current loop is enabled. In this regard, once the high current loop is enabled, the low-current loop is disabled through a positive feedback.

The series of NMOS transistors: M1, M2 and M3 are introduced between the main regulator and the low current regulator act as a low quiescent loop saturation detection mechanism 510. The low quiescent current regulation loop is arranged to be active, so long as the following condition exists:

$$Vgs_M3 < Vgs_M2 + Vgs_M1 \quad [1]$$

Thus, once the gate-source voltage threshold of M3 has been exceeded the first transistor M1 conducts current and biases the main regulator loop.

A small buffer stage has been introduced between the output of the first stage of the low quiescent current loop and the pass device M3. This facilitates the removal of the pass device M3 from the low quiescent current loop once the high current loop is enabled. Once the pass device M3 of the high current loop drives current, there is also current mirrored into the device mentioned with device 540. This current is a fraction (1/X) of the high current pass device. Once this current becomes higher than the current in the buffer stage, which is very small and of the order of ~0.5 uA, the Vgs_M3 is effectively short circuited and device 540 will source more current than buffer is able to sink. Thus, M3 stops driving current and only the high current pass device is driving current.

In a comparable manner, the low quiescent current loop regulator becomes active when the following condition exists:

$$Iload < X * Ibias/2. \quad [2]$$

Where:

$$Icc = Ibias + I_R \quad [3]$$

Thus, the low quiescent loop operates from approximately ~2 uA+2-4 uA.

Finally, the known common resistor feedback ladder 350 is provided, where the resistor ratio defines the output voltage ($V_{out}$). An associated external capacitor 340 is incorporated to provide fast buffering to accommodate load changes, as in the known classical topology.

Thus, depending on the current load, the operation of the proposed architecture shifts from the low quiescent loop 510 to the main regulator loop 505.

It is within the contemplation of the inventive concept hereinbefore described that an alternative arrangement may comprise monitoring the output current of the two pass devices and switching from one loop to the other, dependent upon the result of the monitoring operation. For example, a fraction of the low-current regulation loop pass device would be compared to a reference value. Once the fraction is monitored as being higher than the reference value, the high current loop is enabled as the required output current becomes too large to be driven by the low current loop.

From the opposite direction, the current of the high-current loop is monitored. Once a fraction of the pass device becomes lower than the reference, the circuit switches to the low current loop, as the output load current becomes sufficiently low to be driven by the low-current loop.

A summary of the preferred operation of the voltage regulator is illustrated in the flowchart 600 of FIG. 6.

The process starts in step 605 with the voltage regulator being configured to operate in a low-current mode using a second auxiliary loop, as shown in step 610. The second loop is monitored to determine when it saturates, for example by monitoring a current level on a port of the second auxiliary loop's pass device, as in step 615. If the second auxiliary loop is not saturated, a low-current mode of operation is maintained, by looping back to step 610.

If it is determined that the second auxiliary loop saturates in step 615, the voltage regulator automatically transitions to use of the main current loop to provide a high-current voltage regulated output, as in step 620. Preferably, the second auxiliary loop is still monitored to determine whether it remains saturated, as in step 625.

If it is determined that the second auxiliary loop remains saturated in step 625, the voltage regulator maintains its use of both the main current loop and the auxiliary current loop to provide a high-current voltage regulated output, as in step 620. However, if it is determined that the second loop is no longer saturated in step 625, the main loop of the voltage regulator is disabled, as in step 635, and the operation reverts back to solely using the second auxiliary loop in step 610.

It is envisaged that alternative arrangements of low load detection can be implemented. One example of a low-load detection arrangement that can be applied to the inventive concept hereinbefore described is whereby a portion of the M3 transistor voltage is compared to a reference voltage level. Such an arrangement provides increased accuracy. However, such increased accuracy comes at the expense of requiring the use of an additional tail current.

Advantageously, the preferred embodiment of the present invention maintains operation in the low quiescent current mode for as long as possible, without any degradation in performance.

Although the preferred embodiment of the present invention has been described with regard to a 90%/10% ratio in supplying high current or low current to a variable load, it is within the contemplation of the present invention that alternative ratios may be used, dependent upon the particular application, devices or circuit topology used or the loads requiring supporting.

Furthermore, it is envisaged that the inventive concept hereinbefore described can be extrapolated to comprise any number of separate or inter-operable loops, whose operation is load dependent. For example, it is envisaged that for some applications, there could be, say, four distinct current output levels dependent upon the circuit or device forming the load. In such a case, four parallel loops may be implemented to provide the four distinct current levels. In this regard, it is envisaged that four distinct loops may be respectively configured to provide 2 uA, 4 uA, 6 uA and 8 uA. Thus, a load that requires 20 uA would require the enabling of the high current 20 uA loop.

Alternatively, if a configuration was implemented that combined the currents supplied; the four loops may be configured with 2 uA, 4 uA, 6 uA and 8 uA. In this alternative configuration, a load that requires 20 uA would require all four loops in operation, whereas a load that requires only 10 uA would require only the second and third loops.

It is within the contemplation of the present invention that the inventive concept hereinbefore described is equally applicable to any analogue linear power system where the intrinsic integrated circuit (IC) current consumption has to be lowered, when no power has to be delivered to a load.

It is also envisaged that the aforementioned inventive concepts may also be embodied in any suitable semiconductor device or devices. For example, a semiconductor manufacturer may employ the inventive concepts in a design of a stand-alone integrated circuit (IC) and/or application specific integrated circuit (ASIC) and/or any other sub-system element. Furthermore, it is envisaged that the inventive concept hereinbefore described is applicable to any low drop-out voltage regulator, such as those used in audio or power management ICs.

The voltage regulator and integrated circuit therefor, as described above, aims to provide at least one or more of the following advantages:

(i) The architecture dramatically reduces the quiescent current requirements, say of low drop-out regulators under low load conditions;

(ii) Provides an automatic optimized regulation loop selection; and (iii) Avoids any processor involvement in switching the regulator between low load and high load conditions.

Whilst specific, and preferred, implementations of the present invention are described above, it is clear that one skilled in the art could readily apply variations and modifications of such inventive concepts.

Thus, a voltage regulator, integrated circuit and method of providing a regulated voltage, have been described wherein the abovementioned disadvantages associated with prior art arrangements has been substantially alleviated.

The invention claimed is:

1. A voltage regulator for providing a voltage regulated output to a load, the voltage regulator comprising:

a first voltage feedback loop having a first active device coupled to a first pass device, the first active device configured to provide a first current output to the load; and a second voltage feedback loop having a second active device coupled to a second pass device, the second active device configured to provide a second current output to the load where the second current is low relative to the first current; and means for determining a load condition of the voltage regulator wherein the first voltage feedback loop and the second voltage feedback loop form two independent loops to provide either the first current or the second current to the load in response to the load condition.

2. A voltage regulator according to claim 1 wherein a transition between operation of the first voltage feedback loop and operation of the second voltage feedback loop occurs automatically dependent upon current conditions within the second voltage feedback loop.

3. A voltage regulator according to claim 2 wherein the voltage regulator switches between operation of the first voltage feedback loop and second voltage feedback loop in response to current requirements of the load.

4. A voltage regulator according to claim 1 wherein the voltage regulator switches between operation of the first voltage feedback loop and second voltage feedback loop in response to current requirements of the load.

5. A voltage regulator according to claim 4 wherein the first active device and second active device are differential amplifiers.

6. A voltage regulator according to claim 1 wherein the determination of the load condition is performed by detecting saturation of the second pass device.

7. A voltage regulator according to claim 6 wherein upon detecting saturation of the second pass device operation of the first voltage feedback loop is automatically activated.

8. A voltage regulator according to claim 6 wherein the first active device and second active device are differential amplifiers.

9. A voltage regulator according to claim 1 wherein the first active device and second active device are differential amplifiers.

10. A voltage regulator according to claim 1 wherein a plurality of distinct voltage feedback loops are combined to provide a respective summation of current levels to the load.

11. A voltage regulator according to claim 1 wherein the voltage regulator is a low drop-out voltage regulator.

12. A voltage regulator according to claim 1 wherein a value of the second current is substantially in the region of 0.1% to 10% relative to a value of the first current being substantially in the region of 90% to 99.9% of a total current provided by the voltage regulator.

13. An integrated circuit comprising a voltage regulator according to claim 1.

14. A method of providing a regulated voltage to a load comprising:

providing a first current output to a load of a voltage regulator, by a first active device coupled to a first pass device, using a first voltage feedback loop;

providing a second current output to a load of the voltage regulator, by a second active device coupled to a second pass device, using a second voltage feedback loop, wherein the second current is low relative to a first current;

determining a current saturation condition within the second voltage feedback loop; and transitioning automatically between providing either the first current to the load or second current to the load in response to the current saturation condition.

15. A method of providing a regulated voltage to a load according to claim 14 wherein a value of the second current is substantially in the region of 0.1% to 10% relative to a value of the first current being substantially in the region of 90% to 99.9% of a total current provided by the voltage regulator.

16. A method according to claim 14 wherein the first current and the second current combine to provide a respective summation of current levels to the load.

17. A method of providing a regulated voltage to a load according to claim 14 wherein the first active device and second active device are differential amplifiers.

18. A method of providing a regulated voltage to a load comprising:

providing a first current output to a load of a voltage regulator, by a first active device coupled to a first pass device, using a first voltage feedback loop;

providing a second current output to a load of the voltage regulator, by a second active device coupled to a second pass device, using a second voltage feedback loop, wherein the second current is low relative to a first current and wherein the first active device and second active device are differential amplifiers;

determining a load condition of the voltage regulator; and transitioning automatically between providing either the first current to the load or second current to the load in response to the load condition.

19. A method according to claim 18 wherein the transitioning occurs automatically dependent upon current conditions within the second voltage feedback loop.

20. A method according to claim 18 further comprising:

switching between operation of the first voltage feedback loop and second voltage feedback loop in response to current requirements of the load.

* * * * *